US010093449B2

(12) United States Patent
Han et al.

(10) Patent No.: US 10,093,449 B2
(45) Date of Patent: Oct. 9, 2018

(54) DOUBLE-SURFACE CONTACT TRAY LOADING BASE

(71) Applicant: CRRC MEISHAN CO., LTD., Meishan, Sichuan (CN)

(72) Inventors: Jingang Han, Meishan (CN); Ping Zheng, Meishan (CN); Shiwei Yang, Meishan (CN); Yi Wang, Meishan (CN); Aimin Wang, Meishan (CN); Dong Li, Meishan (CN); Jianchao Li, Meishan (CN); Liao Peng, Meishan (CN); Pu Wang, Meishan (CN)

(73) Assignee: CRRC MEISHAN CO., LTD., Meishan, Sichuan (CN)

( * ) Notice: Subject to any disclaimer, the term of this patent is extended or adjusted under 35 U.S.C. 154(b) by 0 days.

(21) Appl. No.: 15/568,454

(22) PCT Filed: Feb. 4, 2016

(86) PCT No.: PCT/CN2016/073432
§ 371 (c)(1),
(2) Date: Oct. 20, 2017

(87) PCT Pub. No.: WO2016/169320
PCT Pub. Date: Oct. 27, 2016

(65) Prior Publication Data

US 2018/0111716 A1 Apr. 26, 2018

(30) Foreign Application Priority Data

Apr. 23, 2015 (CN) ..... 2015 1 0196700

(51) Int. Cl.
*A47F 5/08* (2006.01)
*B65D 19/38* (2006.01)
(Continued)

(52) U.S. Cl.
CPC ..... *B65D 19/385* (2013.01); *A47B 57/42* (2013.01); *B65G 1/14* (2013.01); *A47B 57/40* (2013.01)

(58) Field of Classification Search
CPC ..... A47B 57/42; A47B 57/30; A47B 57/40; A47B 57/402; B65D 19/385; B65G 1/14
(Continued)

(56) References Cited

U.S. PATENT DOCUMENTS 414,169 A * 10/1889 Reuschel ..... E04B 1/2612 248/300
939,005 A * 11/1909 Goedeke ..... B65D 9/34 190/37

(Continued)

FOREIGN PATENT DOCUMENTS

CN 102258275 * 3/2014

*Primary Examiner* — Abigail E Troy
*Assistant Examiner* — Devin K Barnett
(74) *Attorney, Agent, or Firm* — Kile Park Reed & Houtteman PLLC

(57) ABSTRACT

A double-surface contact tray loading base comprises a loading surface (4) and a hook (1) arranged on an outer end of the loading surface (4), the hook (1) comprises a hook lug (1-2) and a support plate (6), the hook lug (1-2) is arranged on an upper side of the outer end of the loading surface (4), and the support plate (6) is arranged on a lower side of the outer end of the loading surface (4), thus forming the double-surface contact tray loading base.

5 Claims, 2 Drawing Sheets

(51) Int. Cl.
*B65G 1/14* (2006.01)
*A47B 57/42* (2006.01)
*A47B 57/40* (2006.01)

(58) Field of Classification Search
USPC ..... 211/85.12, 87.01, 88.01, 90.01, 90.02, 211/94.01, 113, 126.1, 126.2, 183, 187; 248/407, 423, 220.41, 220.43, 217.1, 250; 108/144.11, 147.11, 147.17; 206/806
See application file for complete search history.

(56) References Cited

U.S. PATENT DOCUMENTS 939,368 A * 11/1909 Withem ..... F22B 37/202 122/510
1,055,050 A * 3/1913 Knape ..... A47B 57/42 16/440
1,140,940 A * 5/1915 Bales ..... A47B 57/42 211/87.01
1,346,955 A * 7/1920 Gustafson ..... F16B 12/46 248/188
1,354,270 A * 9/1920 Wood ..... A47B 96/061 180/68.5
1,380,518 A * 6/1921 Bellig ..... F16B 12/46 135/909
1,393,012 A * 10/1921 Dilg ..... A47B 57/485 248/243
1,504,522 A * 8/1924 Sherer ..... A47F 3/12 108/102
1,852,598 A * 4/1932 Vogt ..... A47B 57/425 248/222.51
1,853,018 A * 4/1932 Knape ..... A47B 57/425 248/243
2,168,911 A * 8/1939 Meyer ..... A47F 5/005 217/69
2,252,997 A * 8/1941 Vanderveld ..... A47B 96/1458 248/243
2,553,960 A * 5/1951 De Swart ..... A47B 57/425 126/337 R
2,710,735 A * 6/1955 Stollenwerk ..... A47B 57/56 248/218.4
D176,637 S * 1/1956 Sivertson ..... 211/88.01
2,815,910 A * 12/1957 Baker ..... A47J 47/16 248/220.1
2,839,350 A * 6/1958 Hill ..... A47B 57/425 211/134
2,894,710 A * 7/1959 Shields ..... A47H 1/124 248/265
2,954,125 A * 9/1960 Husted ..... A47F 5/0823 108/149
2,982,423 A * 5/1961 Handler ..... A47F 5/0025 211/126.1
3,054,511 A * 9/1962 Erismann ..... A47B 57/485 108/108
3,097,746 A * 7/1963 Handler ..... A47B 57/425 108/108
3,199,683 A * 8/1965 Graswich ..... A47B 57/425 108/109
3,273,844 A * 9/1966 Hodson ..... A47F 5/0807 248/216.1
3,319,917 A * 5/1967 Bilodeau ..... A47F 5/0823 248/220.43
3,393,521 A * 7/1968 Cammisa ..... E02D 17/08 211/182
3,452,954 A * 7/1969 Lucietto ..... A47F 5/0823 185/40 R
3,471,111 A * 10/1969 MacDonald ..... A47B 96/063 108/152
3,471,112 A * 10/1969 MacDonald ..... A47B 96/063 108/109
3,502,294 A * 3/1970 Kalbow ..... A47F 5/0025 211/41.2
3,561,715 A * 2/1971 Klein ..... A47B 57/425 211/135
3,692,265 A * 9/1972 Barriger ..... F16B 12/46 248/220.1
3,826,207 A * 7/1974 Sutherlan ..... A47B 57/485 108/101
3,985,325 A * 10/1976 Ginsburg ..... A47F 5/0823 248/220.22
4,230,052 A * 10/1980 Champagne ..... A47B 57/30 108/107
4,322,006 A * 3/1982 Marschak ..... A47F 5/0823 211/126.2
4,405,110 A * 9/1983 Gibbons ..... A47F 5/0823 248/220.22
4,432,523 A * 2/1984 Follows ..... A47B 57/30 108/110
4,508,301 A * 4/1985 Nicholson ..... A47B 96/065 108/152
4,575,164 A * 3/1986 Pinnow ..... A47B 57/404 108/109
D289,495 S * 4/1987 Hughes ..... D6/567
4,666,117 A * 5/1987 Taft ..... A47B 96/063 108/108
4,681,289 A * 7/1987 Gronlund ..... A47B 88/43 248/201
4,688,683 A * 8/1987 Thalenfeld ..... A47F 5/0823 211/57.1
4,732,358 A * 3/1988 Hughes ..... A47B 96/068 108/108
4,735,391 A * 4/1988 Lawrence ..... A47K 1/08 211/90.01
4,757,909 A * 7/1988 Matsuura ..... B65D 11/1833 217/69
4,765,575 A * 8/1988 Bergl ..... A47B 96/065 108/152
4,830,323 A * 5/1989 Harley ..... A47B 96/063 108/108
4,843,977 A * 7/1989 Bridges ..... A47B 96/061 108/13
4,856,746 A * 8/1989 Wrobel ..... A47B 96/063 108/107
4,886,236 A * 12/1989 Randall ..... A47B 96/022 108/152
4,909,465 A * 3/1990 Lyman ..... A47B 96/068 108/108
D307,222 S * 4/1990 Korpijaako ..... D6/540
4,934,642 A * 6/1990 Baron ..... A47B 96/065 108/108
5,064,158 A * 11/1991 Brazier ..... A47B 96/063 108/152
5,312,078 A * 5/1994 Marsh ..... A47B 96/06 248/220.1
5,346,078 A * 9/1994 Ernetoft ..... A47F 5/0846 211/40
5,452,875 A * 9/1995 Kern ..... A47B 57/045 108/108
5,456,435 A * 10/1995 Sweeney ..... A47B 57/40 211/90.01
5,509,634 A * 4/1996 Gebka ..... G09F 3/204 24/336
5,695,163 A * 12/1997 Tayar ..... A47B 57/485 248/225.21
5,921,411 A * 7/1999 Merl ..... A47B 96/00 108/108
6,186,456 B1 * 2/2001 Marsh ..... A47B 96/022 108/108
6,189,707 B1 * 2/2001 Meyers ..... A47B 57/045 108/108
6,302,283 B1 * 10/2001 Yeh ..... A47F 5/116 108/109
6,487,978 B1 * 12/2002 Hamberg ..... A47B 57/42 108/106
6,488,347 B1 * 12/2002 Bienick ..... A47B 96/027 108/108
6,669,029 B1 * 12/2003 Beane ..... H05K 7/183 108/108

(56) References Cited

U.S. PATENT DOCUMENTS

D490,295 S * 5/2004 Neider ..... D8/356
D553,972 S * 10/2007 Prichard, Jr. ..... D8/499
7,300,120 B2 * 11/2007 Shin ..... F25D 23/04 108/108
7,347,404 B2 * 3/2008 Anzai ..... A47B 96/065 108/152
8,042,892 B2 * 10/2011 Benz ..... A47B 57/562 108/108
8,061,539 B2 * 11/2011 Punzel ..... A47B 57/10 108/108
8,087,522 B2 * 1/2012 Stafford ..... A47F 5/0025 108/108
8,157,230 B2 * 4/2012 Krueger ..... A47B 96/068 248/220.43
8,231,191 B2 * 7/2012 Leconte ..... A47B 96/062 108/108
8,453,982 B2 * 6/2013 Baruch ..... A47B 96/022 108/147.11
8,690,471 B2 * 4/2014 Wians ..... A47F 5/0018 108/147.15
8,926,034 B2 * 1/2015 Park ..... A47B 96/025 108/102
8,960,827 B2 * 2/2015 McMillin ..... A47B 96/027 108/108
9,220,203 B2 * 12/2015 Vaughn ..... A01G 9/02
D753,465 S * 4/2016 Marsh ..... D8/349
D795,681 S * 8/2017 Rosen ..... D8/381
2002/0166934 A1 * 11/2002 Marsh ..... A47B 57/48 248/235
2003/0020387 A1 * 1/2003 Wing ..... A47B 45/00 312/408
2003/0094427 A1 * 5/2003 Suttles ..... A47B 55/02 211/187
2003/0168560 A1 * 9/2003 Chipka ..... A47B 57/565 248/218.4
2003/0233965 A1 * 12/2003 Brazier ..... A47B 96/028 108/108
2005/0189308 A1 * 9/2005 Warner ..... A47F 5/0823 211/59.1
2006/0102567 A1 * 5/2006 Stukenberg ..... A47G 1/1646 211/41.1
2007/0284491 A1 * 12/2007 La ..... A47B 96/061 248/217.1
2009/0090683 A1 * 4/2009 Haghayegh ..... A47B 96/022 211/90.01
2009/0107936 A1 * 4/2009 Scriba ..... A47F 5/0807 211/88.01
2010/0258693 A1 * 10/2010 Toshima ..... A47B 96/06 248/250
2012/0018601 A1 * 1/2012 DeVito ..... A47F 5/0807 248/220.42
2013/0087520 A1 * 4/2013 Cutler ..... A47K 3/281 211/85.12
2013/0228541 A1 * 9/2013 O'Hara ..... A47B 96/022 211/134
2014/0175031 A1 * 6/2014 Roberts ..... H02J 7/0027 211/26.2
2016/0120311 A1 * 5/2016 Huang ..... A47B 47/021 211/186

* cited by examiner

DOUBLE-SURFACE CONTACT TRAY LOADING BASE

TECHNICAL FIELD

A double-surface contact tray loading base relates to a cargo transport device, in particular to a tray for container transportation, belonging to the technical field of cargo transport.

BACKGROUND ART

At present, during the container transportation of cargo, trays are widely used in a compartment for the purpose of sorting and layering cargo, however, in terms of tray support, a simple method is adopted, which is implemented by hanging the hooks and loading surfaces on brackets which are mounted on the side walls of the compartment, so as to support the trays. In this structure, the state of stress on the hooks is bad, the strength and fatigue life of the hooks are lower, the problem of stress concentration occurs frequently. When in use, the device is prone to cracks, even tears, resulting in a severe impact on the safety of cargo transport.

SUMMARY OF THE INVENTION

The present invention aims to solve the problems mentioned above, and provides a tray support device having reasonable stress state and improved loading capability and service life. The technical solution is as follows:

The device comprises a loading surface and a hook arranged on an outer end of the loading surface, and is characterized in that the hook comprises a hook lug and a support plate, the hook lug is arranged on an upper side of the outer end of the loading surface, the support plate is arranged on a lower side of the outer end of the loading surface, thus forming the double-surface contact tray loading base.

The lower end of the hook lug has a mounting surface at the lower end connected to the upper side of the outer end of the loading surface, and the upper end of the hook lug has an inner contact surface.

The lower end of the support plate has an outer contact surface.

A longitudinal stopper and a transversal stopper are arranged at the adjacent edges of the loading surface, respectively.

A reinforcement rib is arranged at the bottom of the loading surface. The outer end of the loading surface is tilted upwards with an angle of 3-50 degrees. The longitudinal stopper is tilted towards the direction of the hook with an angle of 2-30 degrees.

Compared with the prior art, the present invention has the following benefits:

1. The hook lug and the support plate are respectively arranged on the upper and lower sides of the outer end of the loading surface, thus forming the double-surface contact tray loading base. In a working position, the base is mounted in a seat form on a bracket which is mounted on the side wall of a compartment, with the mounting surface of the hook lug being pressed on a square hole of the bracket, the inner contact surface of the hook lug being in contact with the inner surface on the upper side of the bracket, the outer contact surface of the support plate being in contact with the outer surface on the lower side of the bracket, thus changing the single-sided stress state in the prior art. With the double-sided contact stress between the hook lug and support plate and the bracket, the stress area is increased, the stress delivered to the bracket is dispersed, and the stress delivered to the side wall and the bracket is reduced, as a result, the problem of stress concentration in the existing structures is avoided, the stability of the base is improved, the loading capacity of the base is increased by 80%, the service life is increased by about 68%, thus ensuring the safety of cargo transport.
2. The hook lug and the support plate limit the transversal movement of the base to prevent the base from falling from the bracket, thus ensuring the stability of the base.
3. The longitudinal stopper and the transversal stopper are arranged at the adjacent edges of the loading surface respectively, so as to limit the transversal and longitudinal movement of the base, thus ensuring the stability of the base during the cargo transport process.
4. Taking the horizontal plane as reference, the outer end of the loading surface is tilted upwards with an angle of 3-50 degrees, and when a load is applied to the loading surface of the base, the base deforms, thus ensuring the loading surface in the horizontal position.
5. The longitudinal stopper is tilted towards the direction of the hook with an angle of 2-30 degrees, so as to take the guide effect when the base is mounted.
6. The use of the reinforcement rib improves the strength of the base, increases the vertical loading capability of the base, and increases the fatigue life and service life.

DETAILED DESCRIPTION OF THE INVENTION

The Embodiment 1

Figure 1:
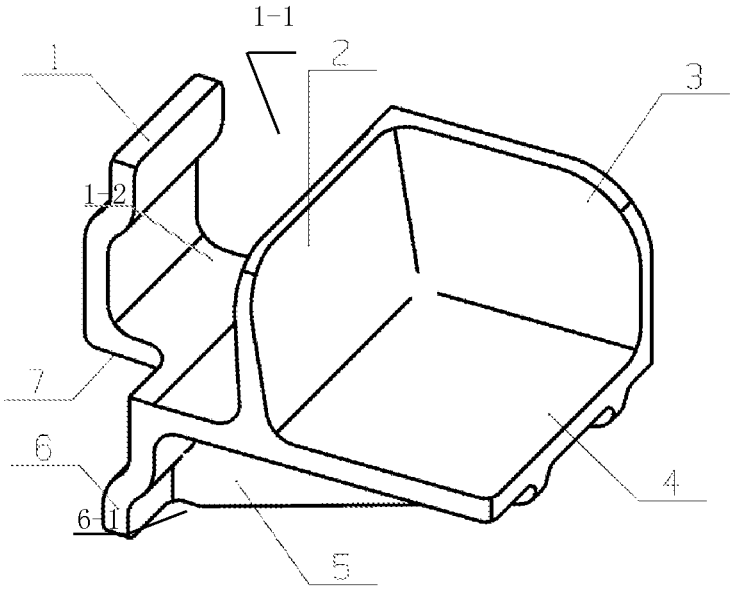
FIG. 1 schematically shows a structure of a base of the present invention.
Figure 2:
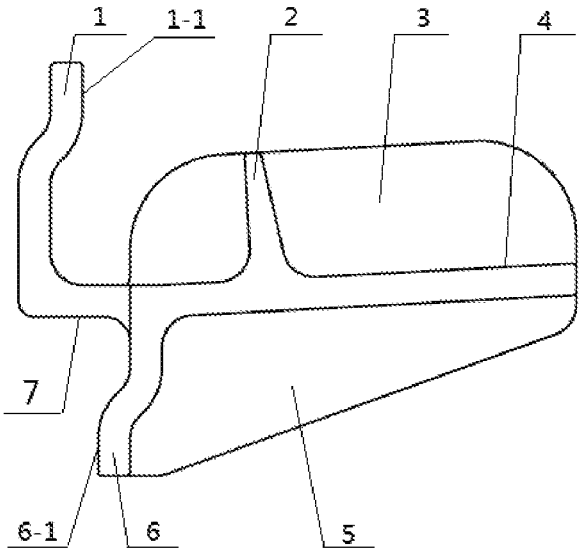
FIG. 2 is a front view of a base of the present invention.

Referring to FIG. 1 and FIG. 2, the present embodiment comprises a loading surface 4 and a hook 1 arranged on the outer end of the loading surface 4, and is characterized in that the hook 1 comprises a hook lug 1-2 and a support plate 6, the hook lug 1-2 is arranged on an upper side of the outer end of the loading surface, the support plate 6 is arranged on a lower side of the outer end of the loading surface, thus forming the double-surface contact tray loading base. The hook lug 1-2 has a mounting surface 7 at the lower end, which is connected to an upper side of the outer end of the loading surface, and the hook lug has an inner contact surface 1-1 at the upper end. The support plate 6 has an outer contact surface 6-1 at the lower end.

The Embodiment 2

The present embodiment comprises a loading surface 4 and a hook 1 arranged on an outer end of the loading surface 4, and is characterized in that the hook 1 comprises a hook lug 1-2 and a support plate 6, the hook lug 1-2 is arranged on an upper side of the outer end of the loading surface, the support plate 6 is arranged on a lower side of the outer end of the loading surface, thus forming the double-surface contact tray loading base. The hook lug 1-2 has a mounting surface 7 at the lower end, which is connected to the upper side of the outer end of the loading surface, and the hook lug has an inner contact surface 1-1 at the upper end. The support plate 6 has an outer contact surface 6-1 at the lower end. A longitudinal stopper 2 and a transversal stopper 3 are arranged at the adjacent edges of the loading surface 4, respectively.

The Embodiment 3

The present embodiment comprises a loading surface 4 and a hook 1 arranged on an outer end of the loading surface 4, and is characterized in that the hook 1 comprises a hook lug 1-2 and a support plate 6, the hook lug 1-2 is arranged on an upper side of the outer end of the loading surface, the support plate 6 is arranged on a lower side of the outer end of the loading surface, thus forming the double-surface contact tray loading base. The hook lug 1-2 has a mounting surface 7 at the lower end, which is connected to the upper side of the outer end of the loading surface, and the hook lug has an inner contact surface 1-1 at the upper end. The support plate 6 has an outer contact surface 6-1 at the lower end. A longitudinal stopper 2 and a transversal stopper 3 are arranged at the adjacent edges of the loading surface 4, respectively. A reinforcement rib 5 is arranged at the bottom of the loading surface 4.

The Embodiment 4

The present embodiment comprises a loading surface 4 and a hook 1 arranged on an outer end of the loading surface 4, and is characterized in that the hook 1 comprises a hook lug 1-2 and a support plate 6, the hook lug 1-2 is arranged on an upper side of the outer end of the loading surface, the support plate 6 is arranged on a lower side of the outer end of the loading surface, thus forming the double-surface contact tray loading base. The hook lug 1-2 has a mounting surface 7 at the lower end, which is connected to the upper side of the outer end of the loading surface, and the hook lug has an inner contact surface 1-1 at the upper end. The support plate 6 has an outer contact surface 6-1 at the lower end. A longitudinal stopper 2 and a transversal stopper 3 are arranged at the adjacent edges of the loading surface 4, respectively. A reinforcement rib 5 is arranged at the bottom of the loading surface 4. The outer end of the loading surface 4 is tilted upwards with an angle of 3-50 degrees, and the longitudinal stopper 2 is tilted towards the direction of the hook with an angle of 2-30 degrees.

Figure 3:
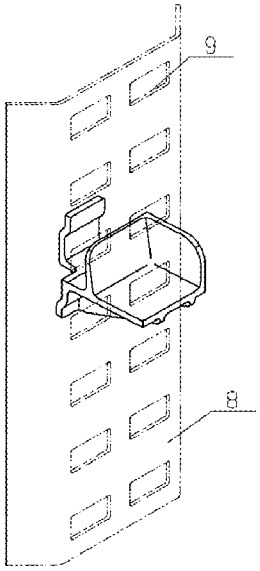
FIG. 3 is a using state of the present invention.
Figure 4:
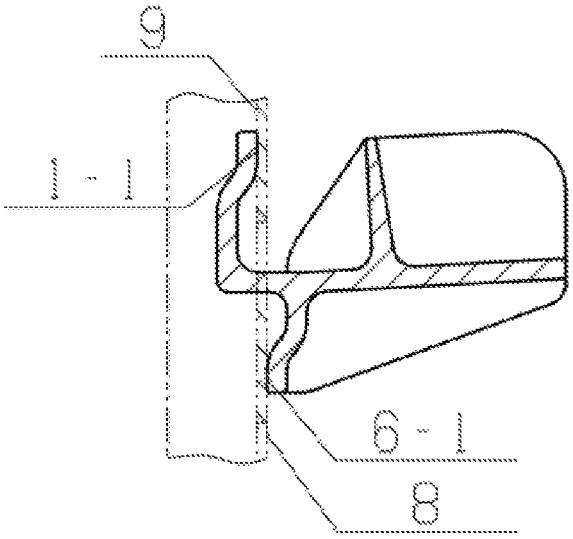
FIG. 4 is partially enlarged sectional view of a using state of the present invention.

When in use, as shown in FIG. 3 and FIG. 4, the base is mounted in a seat form on a bracket 8 which is mounted on the side wall of a compartment, with the mounting surface 7 of the hook lug being pressed on a square hole 9 of the bracket, the inner contact surface 1-1 of the hook lug being in contact with the inner surface on the upper side of the bracket, the outer contact surface 6-1 of the support plate being in contact with the inner surface on the lower side of the bracket, in this manner, the base is mounted in place and then a tray is mounted on the base.

The invention claimed is:

1. A double-surface contact tray loading base, comprising a generally planar horizontal loading surface that is configured to store items thereon, wherein the horizontal loading surface has a top, a bottom, a front edge, a rear edge, and side edges;

a hook defining a hook lug that has a horizontal portion and a vertical portion extending upwardly from the horizontal portion, wherein the vertical portion has an inner surface and an outer surface, and the horizontal portion of the hook lug is attached to and extends directly from the rear edge arranged on an outer end of the loading surface;

a support plate that is attached to and extends downwardly from the bottom of the loading surface, wherein the support plate has an inner surface and an outer surface;

a longitudinal stopper wall extending upwardly from the loading surface; and a transversal stopper wall extending upwardly from the loading surface and generally perpendicularly from the longitudinal stopper wall;

wherein a gap is defined between the vertical portion of the hook lug and the longitudinal stopper wall;

wherein the loading surface, the hook lug, the support plate, the longitudinal stopper wall, and the transversal stopper wall form a unitary one-piece structure;

wherein the vertical portion of the hook lug is configured to be inserted within a mounting hole of a vertical support structure to suspend the double-surface contact tray loading base from the vertical support structure with the vertical support structure being wedged between the inner surface of the vertical portion of the hook lug and the outer surface of the support plate.

2. The double-surface contact tray loading base according to claim 1, wherein a bottom of the horizontal portion of the hook lug defines a mounting surface.

3. The double-surface contact tray loading base according to claim 1, further comprising a reinforcement rib extending between the bottom of the loading surface and the inner surface of the support plate.

4. The double-surface contact tray loading base according to claim 1, wherein the loading surface is tilted upwards at an angle of 3-45 degrees relative to the horizontal portion of the hook lug.

5. The double-surface contact tray loading base according to claim 1, wherein the longitudinal stopper wall is tilted towards the vertical portion of the hook lug at an angle of 2-30 degrees.

* * * * *